US006749493B2

(12) United States Patent
Wuensch

(10) Patent No.: US 6,749,493 B2
(45) Date of Patent: Jun. 15, 2004

(54) HAND-HELD MACHINE TOOL FOR GRINDING, POLISHING, OR THE LIKE

(75) Inventor: Steffen Wuensch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 3 days.

(21) Appl. No.: 10/240,121

(22) PCT Filed: Dec. 6, 2001

(86) PCT No.: PCT/DE01/04607

§ 371 (c)(1),
(2), (4) Date: Sep. 27, 2002

(87) PCT Pub. No.: WO02/062526

PCT Pub. Date: Aug. 15, 2002

(65) Prior Publication Data

US 2003/0109207 A1 Jun. 12, 2003

(30) Foreign Application Priority Data

Feb. 3, 2001 (DE) ..... 101 04 993

(51) Int. Cl.[7] ..... B24B 23/04
(52) U.S. Cl. ..... 451/357; 451/344

(58) Field of Search ..... 451/357, 359, 451/270, 271, 344

(56) References Cited

U.S. PATENT DOCUMENTS 5,357,715 A * 10/1994 Hiramatsu ..... 451/357
5,458,533 A * 10/1995 Barth et al. ..... 451/357

FOREIGN PATENT DOCUMENTS

| | | |
|---|---|---|
| DE | 199 52 108 A | 5/2001 |
| EP | 0 573916 A | 12/1993 |
| WO | 94 07654 A | 4/1994 |

* cited by examiner

*Primary Examiner*—Robert A. Rose
(74) *Attorney, Agent, or Firm*—Michael J. Striker

(57) ABSTRACT

The invention is based on a hand power tool for grinding, polishing, or the like, having a drive motor, a gear coupled with the drive motor, and a grinding wheel (28) operatively connected to the gear.

Figure 1:
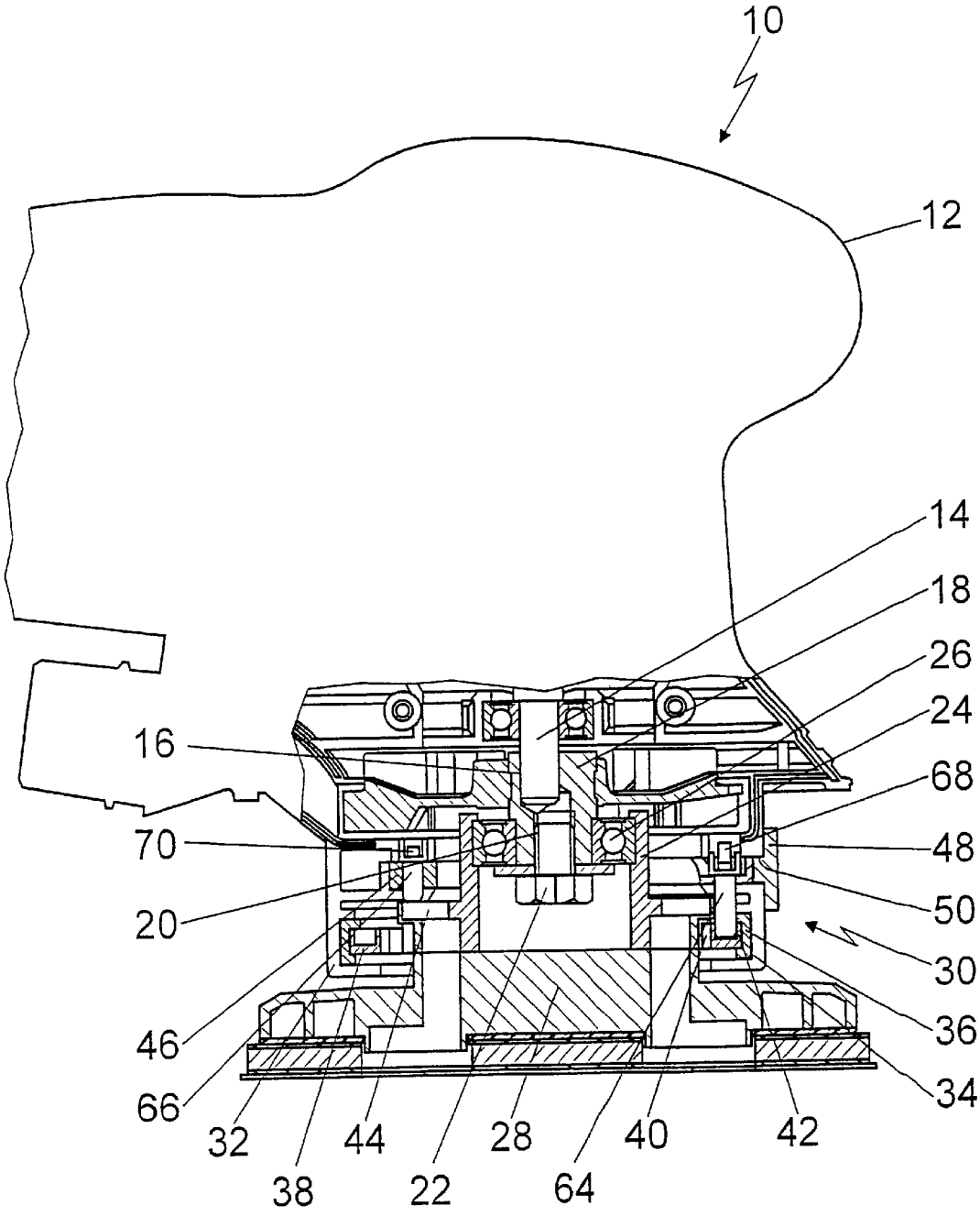

It is proposed that the gear has a switch device (30), by means of which at least two types of grinding wheel motion can be selectable.

12 Claims, 6 Drawing Sheets

HAND-HELD MACHINE TOOL FOR GRINDING, POLISHING, OR THE LIKE

PRIOR ART

The invention is based on a hand power tool for grinding, polishing, or the like, as generically defined by the preamble to claim 1.

It is known for a hand power tool of the type defined above to be designed such that with it, both a grinding wheel motion of an oscillating grinder and a grinding wheel motion of an eccentric grinder can be achieved. The grinding wheel motion of an oscillating grinder is characterized by an orbital motion, which is also called eccentric motion, while the grinding wheel motion of an eccentric grinder is characterized by an orbital motion and a rotary motion. A hand power tool that can be used as both an oscillating grinder and an eccentric grinder is a so-called multipurpose grinder.

The choice of the particular grinding wheel type of motion in such hand power tools is made by attaching a suitably embodied grinding plate.

ADVANTAGES OF THE INVENTION

The invention is based on a hand power tool for grinding, polishing, or the like, having a drive motor, a gear coupled with the drive motor, and a grinding wheel operatively connected to the gear.

It is proposed that the gear has a switch device, by means of which at least two types of grinding wheel motion can be preselectable. A hand power tool embodied in this way has the advantage that the tool can be adapted, without assembly operations, to the particular type of motion of the grinding wheel required, without changing the grinding wheel. Thus the hand power tool of the invention offers great ease of use and great flexibility in terms of the conditions under which it is used.

In an advantageous embodiment of the hand power tool of the invention, in at least one selectable type of motion, an orbital motion of the grinding wheel is effected. In that case, for at least one preselectable operating mode, an oscillating grinder is available to the user.

In at least one preselectable type of motion, a self-rotation of the grinding wheel can be effected. The rotation can be tripped either by the orbital motion of the grinding wheel, or, if the grinding wheel is in a freewheeling mode with regard to a rotation, the rotation can be tripped by the operation of machining a surface. With a freewheeling mode relative to rotation, an especially high quality of the surface treated by means of the power tool can be achieved, since because the grinding wheel can optionally yield rotationally to resistance, the freewheeling mode leads to gentle surface treatment.

If an orbital motion of the grinding wheel trips a self-rotation of the grinding wheel, the grinding wheel is subjected to a so-called forced drive. As a rule, this happens in such a way that via an armature shaft of the drive motor and an eccentric sleeve connected to the drive motor, an additional self-rotation is forced on the grinding wheel.

However, it is also conceivable for a purely rotary motion or exclusively a self-rotation of the grinding wheel, for example, to be preselectable by means of the switch device.

It is also conceivable that by means of the switch device, various eccentric strokes or various rotary speeds of the grinding wheel can be preselected.

In a preferred embodiment of the hand power tool of the invention, the switch device cooperates with two gear wheels that mesh with one another, of which one is connected to the grinding wheel.

The hand power tool of the invention can be designed such that a rotation of at least one of the gear wheels can be prevented by means of the switch device. Thus the rotational behavior of the two gear wheels and the relative motion of them to one another can advantageously be varied, and the type of motion of the grinding wheel can thus be set.

A structurally particularly simple, space-saving embodiment of the hand power tool of the invention is obtained if the first gear wheel connected to the grinding wheel has a set of external teeth, which meshes with a set of internal teeth of the other gear wheel. In that case, the first gear wheel is embodied as a so-called planet wheel, and the second gear wheel is embodied as a so-called ring gear. By a suitable selection of gear wheels, a gear ratio can be set that advantageously allows a high oscillating frequency of the grinding wheel, at a simultaneously low rotary speed of the grinding wheel.

Expediently, the gear wheel having the internal teeth is disposed in a slide bearing ring. On the one hand, this gear wheel is thus supported in a space-saving way, and on the other, there is the advantage that upon rotation of this gear wheel, only slight frictional forces have to be overcome. However, it is also conceivable for instance for the gear wheel with the inner teeth to be disposed in a roller bearing.

A structurally especially simple embodiment of the hand power tool of the invention is obtained if the switch device includes at least one locking bolt, which cooperates with at least one recess in the first gear wheel or in the second gear wheel. By means of such a locking bolt, it is simple to prevent a self-rotation of the respective gear wheel. In the case of a gear wheel with external teeth, embodied as a planet wheel, which is in contact on the one hand with the drive shaft of the drive motor and on the other with the grinding wheel, is eccentrically supported, and meshes with the inner teeth of a ring gear, the engagement of the locking bolt with the recess of the planet wheel, which recess, to compensate for the eccentric driving motion expediently has a larger diameter than the locking bolt, causes an oscillating grinding motion, or a purely orbital motion of the grinding wheel, with the ring gear in the slide bearing ring being carried along in sliding fashion.

However, if the locking bolt engages a recess of the ring gear, thus preventing the rotation of the ring gear in the slide bearing ring, then a self-rotation is imposed on the planet wheel upon its eccentric motion. Hence a self-rotation of the planet wheel is superimposed on the eccentric motion of the same planet wheel.

If the locking bolt engages neither a recess of the planet wheel nor a recess of the ring gear, then the planet wheel is in the freewheeling mode. The grinding wheel connected to the planet wheel can thus also rotate freely.

Preferably, the switch device includes two locking bolts, namely a first locking bolt for engaging a recess of the first gear wheel and a second locking bolt for engaging a recess of the second gear wheel.

Advantageously, for shifting the at least one locking bolt, the switch device has a switching ring. The switching ring acts as the actuating device for the at least one locking bolt. The switching ring is supported for instance in a preferably two-part housing of the gear and is actuatable in the circumferential direction.

Preferably, the switching ring has at least one axial, circular-arclike recess, in which a locking bolt is guided. If the switch device has two locking bolts, then the switching ring preferably has two recesses, with one locking bolt guided in each recess.

Advantageously, the switching ring, in the region of the axial, circular-arclike recess, has a ramplike chamfer, by means of which the at least one locking bolt is axially shiftable by rotation of the switching ring. By suitable disposition of the chamfers, it is possible for one locking bolt, resting with a region of increased diameter on the top side of the switching ring, to engage a recess of the first gear wheel in one position of the switching ring, and for the other locking bolt, in a different position of the switching ring, to engage a recess of the second gear wheel.

In order to keep the at least one locking bolt in position, the locking bolt is urged in the axial direction by means of a spring.

An especially simple embodiment of such a spring pertains in the case of a sheet-metal spring, which engages a recess or slot in the locking bolt and axially loads the locking bolt.

The switching ring can be manually actuated, so that it can be put into whichever switching position is desired by simple manual shifting, or it can be actuated by a control and/or regulating unit via an actuator.

To allow convenient use of the hand power tool of the invention on many surfaces of different outlines without changing the grinding wheel, the grinding wheel preferably has an outline which has at least one straight boundary edge and at least one curved boundary edge.

DRAWING

Further advantages will become apparent from the ensuing description of the drawing. In the drawing, one exemplary embodiment of the invention is shown. The drawing, description and claims include numerous characteristics in combination. One skilled in the art will expediently consider the characteristics individually as well and put them together to make useful further combinations.

Figure 2:
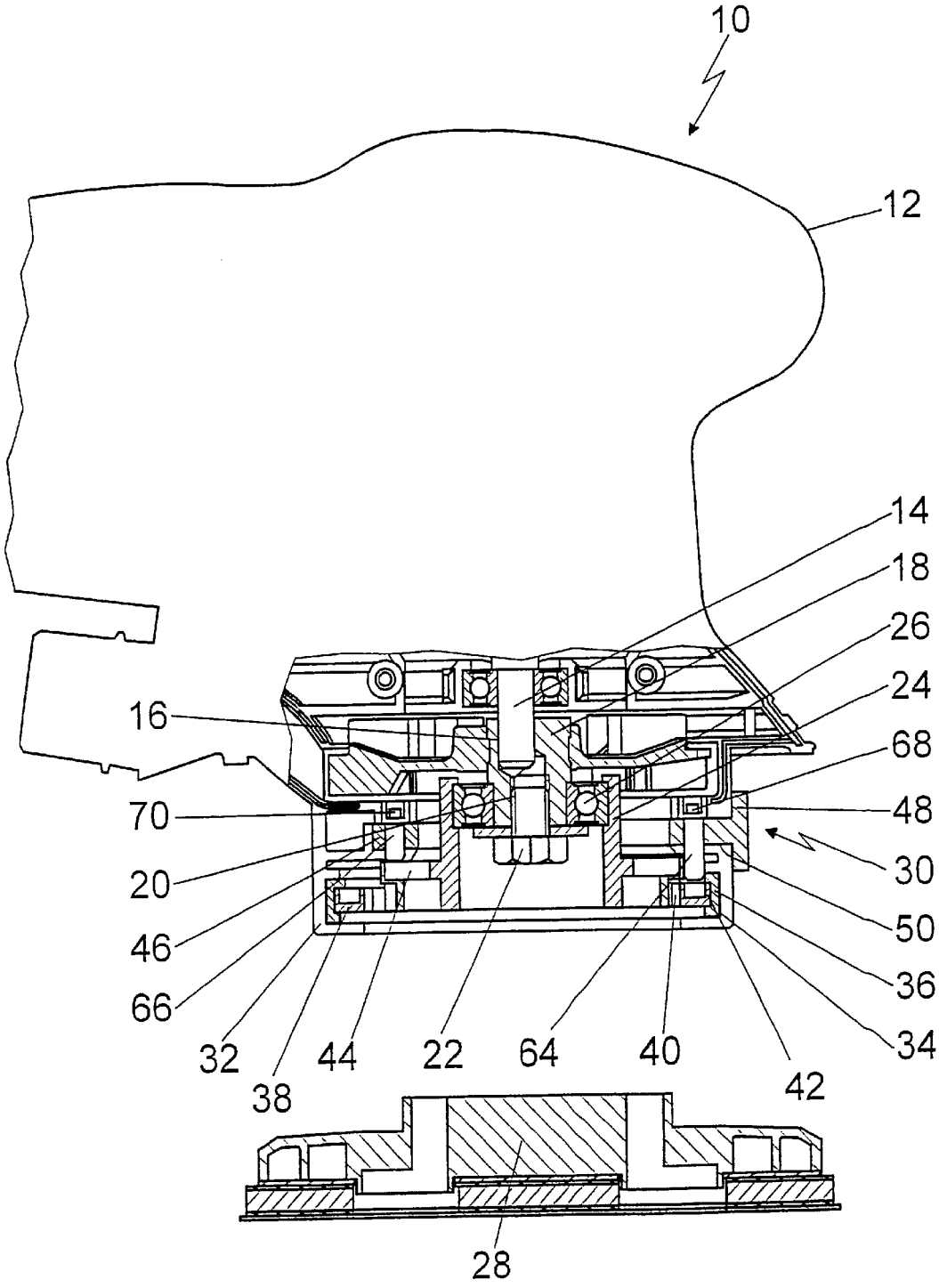
Figure 3:
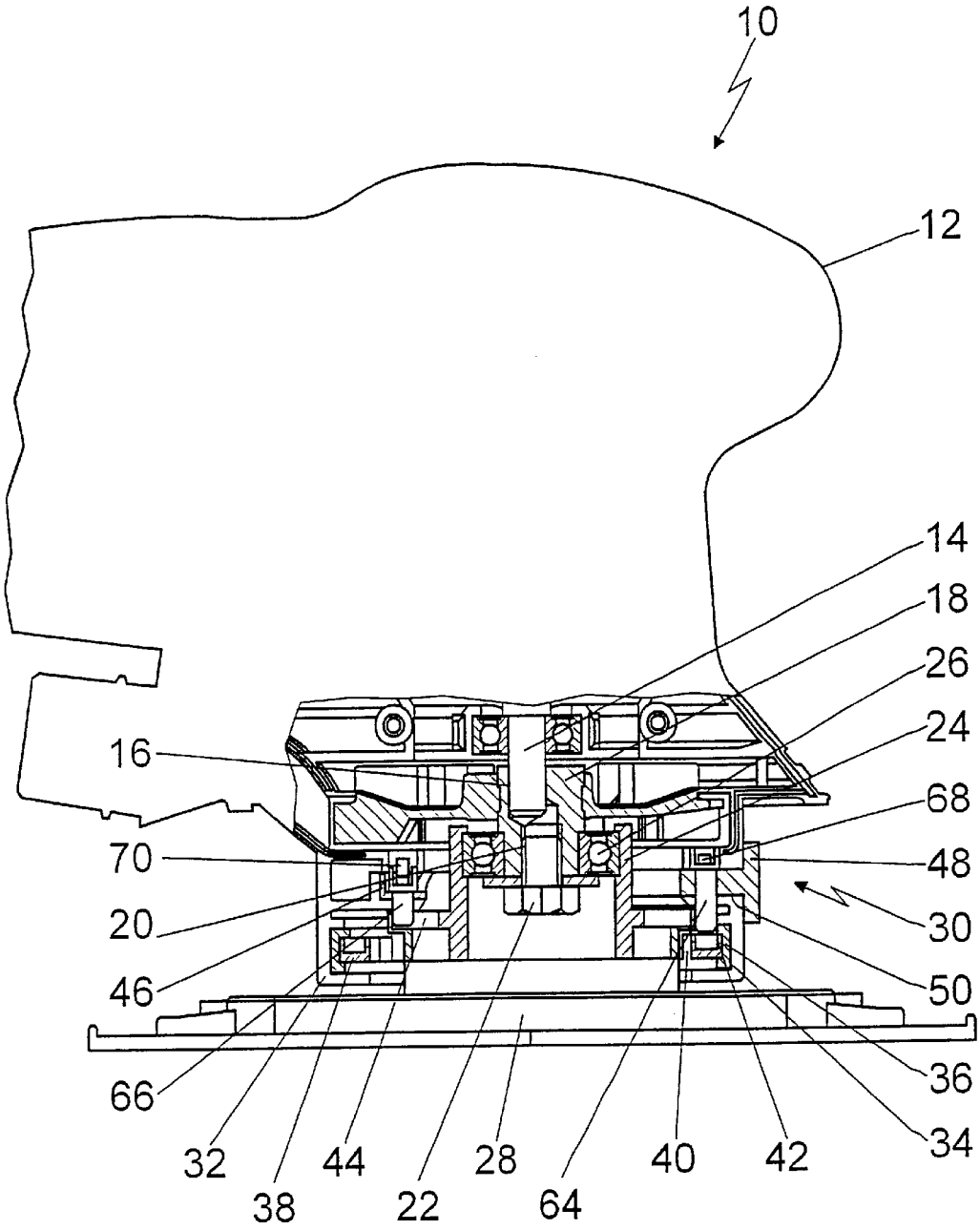
Figure 4:
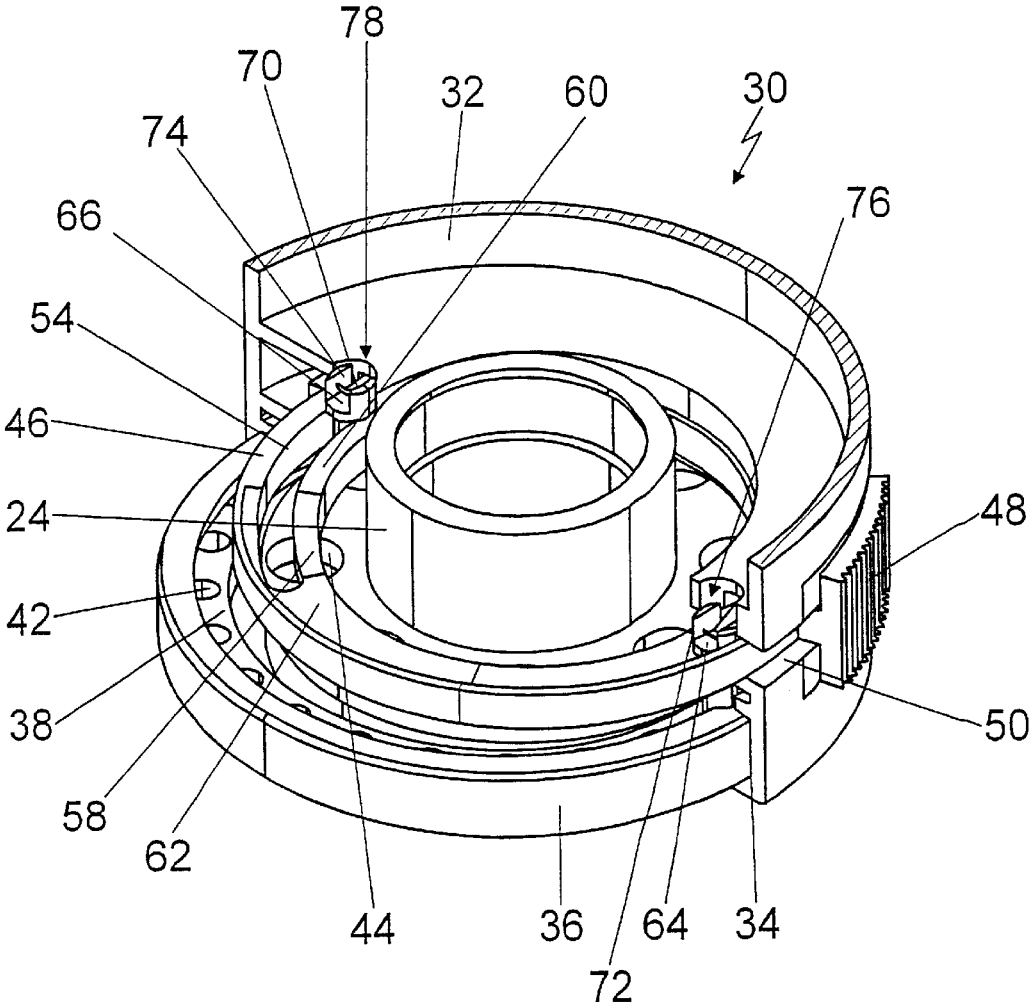
Figure 5:
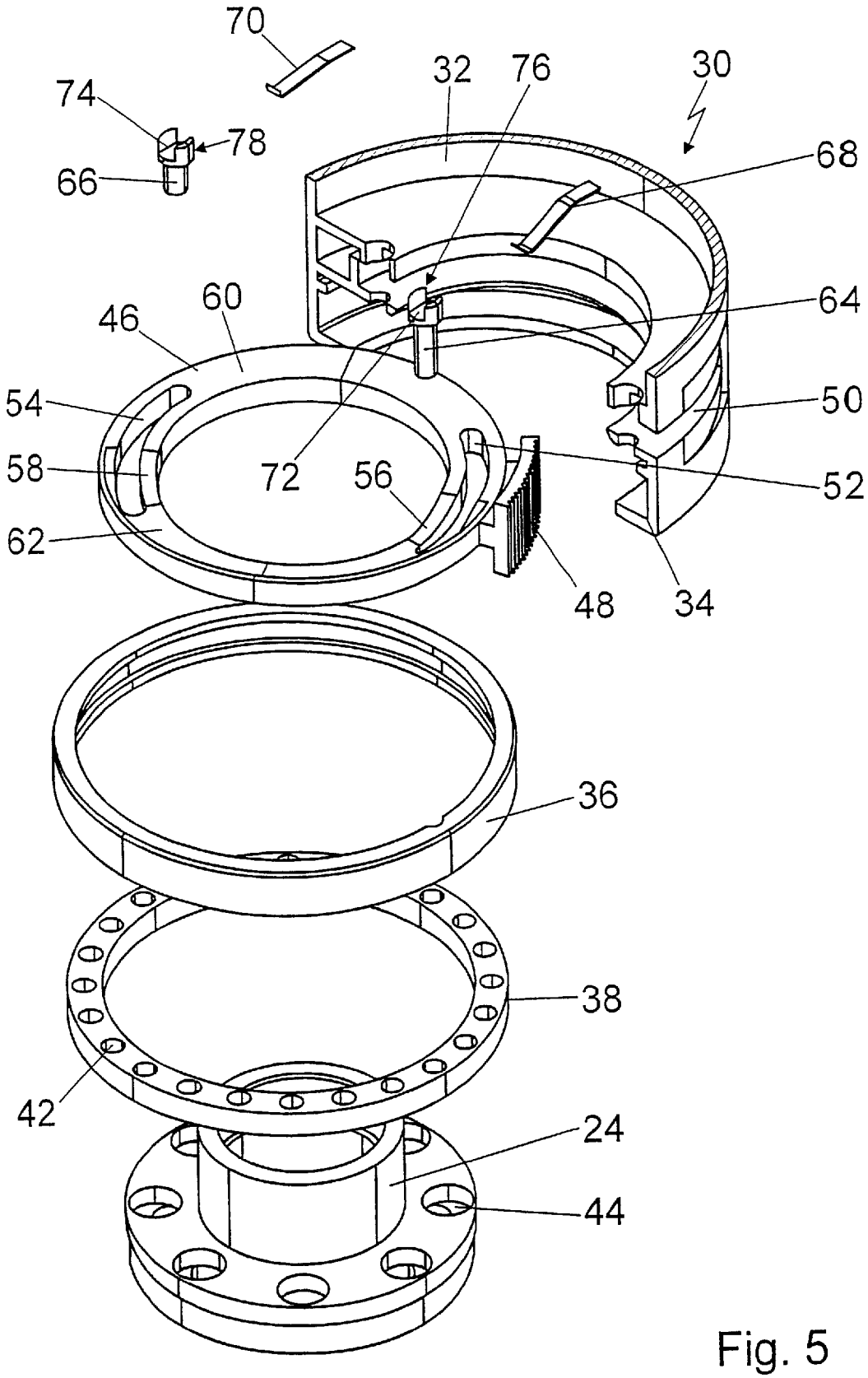
Figure 6:
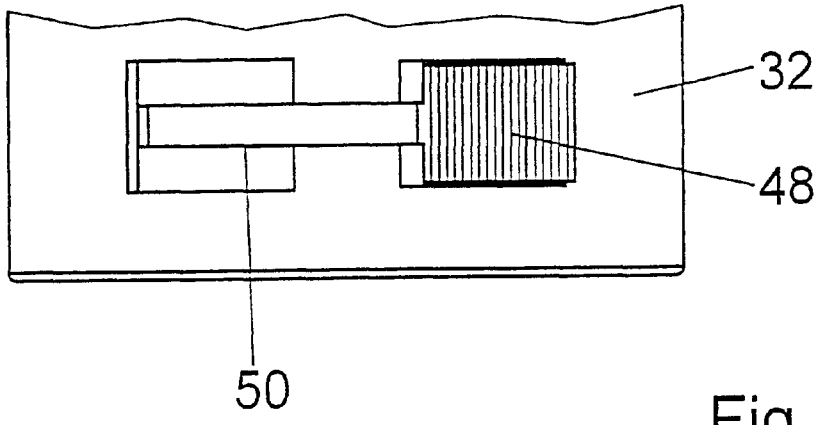

Shown are:

FIG. 1, a schematically shown power grinder of the invention in the eccentric grinding mode, in fragmentary section;

FIG. 2, the power grinder of FIG. 1 in the oscillating grinding mode with a freewheeling mode, in a view corresponding to FIG. 1;

FIG. 3, the power grinder of FIG. 1 in the oscillating grinding mode, in a view corresponding to FIG. 1;

FIG. 4, a perspective view of a switch device of the power grinder of FIG. 1;

FIG. 5, a schematic exploded view of the switch device of FIG. 1, with two meshing gear wheels; and FIG. 6, a manual actuating device of the switch device shown in FIGS. 4 and 5, in a side view.

In FIGS. 1–3, a hand power tool 10 is shown. The hand power tool 10 includes an electric motor, not visible here, which is disposed in a tool housing 12 and drives an armature shaft 14. The armature shaft, in a manner fixed against relative rotation, engages an eccentrically disposed recess 16 of a so-called eccentric sleeve 18.

On the side shown at the bottom in FIGS. 1–3, the eccentric sleeve 18 has a centrally disposed bore 20, which is engaged by a screw 22 that serves to secure a first gear wheel 24. The first gear wheel 24 is secured rotatably on the eccentric sleeve 18 via a ball bearing 26 and is connected to a grinding wheel 28 in a manner fixed against relative rotation.

Depending on the intended application, the grinding wheel 28 can take various forms. FIGS. 1 and 2 each show a grinding wheel for the eccentric grinding mode. Conversely, FIG. 3 shows a grinding wheel 28 for the oscillating grinding mode. However, for all preselectable operating modes, a correspondingly suitable grinding wheel can be used.

Because of the shifted disposition of the recess 16 and the bore 20 of the eccentric sleeve 18, the grinding wheel 28 is supported eccentrically relative to the armature shaft 14. During operation, the axis of the grinding wheel 28 therefore always executes an eccentric motion, that is, a so-called orbital motion, about the axis of the armature shaft.

The power grinder 10 has a switch device 30, by means of which various types of motion of the grinding wheel 28 can be preselected, and which is shown in enlarged views in FIGS. 4–6. The switch device 30 has a two-part housing 32, which is in contact with the tool housing 12 or forms a structural unit with it and which encloses, among other elements, the first gear wheel 24. A slide bearing ring 36 is also received in an annular groove 34 of the housing 32; it serves a bearing for a second gear wheel 38, with a set of internal teeth, not shown in the drawing, that is disposed concentrically to the slide bearing ring 36. The second gear wheel 38, thus embodied as a so-called ring gear, meshes with the first gear wheel 24, which has a set of external teeth, also not shown in the drawing, and acts as a so-called planet wheel. The meshing region of the two gear wheels 24 and 38 shown in the drawing is identified in each case by reference numeral 40.

The second gear wheel 38 is also provided with axial bores 42, disposed at regular intervals in the circumferential direction and embodiment in the manner of blind bores (FIGS. 4–5). The gear wheel 24 with the external teeth is also provided with axial bores 44 disposed at regular intervals in the circumferential direction. However, they are embodied as through bores.

The switch device 30 has a so-called switching ring 46, which is guided displaceably in the circumferential direction in the housing 32. The switching ring 46 has an actuating grip 48, which extends through a radial slot 50 in the housing 32 and is disposed displaceably in the radial slot 50 in the circumferential direction of the housing 32.

The switching ring 46 is disposed eccentrically relative to the housing 32 and serves to preselect various types of motion of the grinding wheel 28. To that end, the switching ring 46 has two curved recesses 52 and 54 that extend axially through the switching ring 46. In the region of the recesses 52 and 54, two ramplike chamfers 56 and 58 are embodied on the top side of the switching ring and connect an upper switching plane 60 with a lower switching plane 62. In each of the recesses 52 and 54, a respective axially extending locking bolt 64 and 66 is guided. The locking bolt 64, which is somewhat longer than the locking bolt 66, serves to engage one of the bores 42 of the second gear wheel 38. Conversely, the locking bolt 66 serves to engage one of the bores 44 of the first gear wheel 24.

Each of the locking bolts 64 and 66 has a respective head 76 and 78, which on the top side of the switching ring 46, and in particular as a function of the position of the switching ring 46, rests on either the upper switching plane 60 or the lower switching plane 62.

The locking bolts 64 and 66 are each urged in the axial direction, in the direction of an engagement position with the bores 42 and 44, respectively, by a respective spring 68 and 70 embodied as a sheet-metal spring. The springs 68 and 70 engage slots 72, 74 on the heads 76, 78 of the bolts 64, 66 and are fastened in the housing 32 by their ends remote from the locking bolts.

In the switching position shown in FIG. 1, the switching ring 46 is in a rotational position, in which the head 76 of the locking bolt 64 rests on the lower switching plane 62, and thus the locking bolt 64 is in a lowered position and with its lower end engages one of the blind borelike bores 42 in the second gear wheel 38. This secures the second gear wheel 38 against relative rotation. Conversely, the head 78 of the locking bolt 66 rests on the upper switching plane 60 of the switching ring 46, so that the first gear wheel 24 can rotate. In this switching position, the grinding wheel 28 is subjected during operation of the power grinder 10 to an eccentric motion, as well as a self-rotation, because of a force drive exerted on the first gear wheel 24 by means of the second gear wheel 38.

In the switching position shown in FIG. 2, the switching ring 46 is in a rotational position in which both the head 76 of the locking bolt 64 and the head 78 of the locking bolt 66 rest on the upper switching plane 60. Thus neither the second gear wheel 38 nor the first gear wheel 24 is secured against relative rotation, and hence with respect to its self-rotation, the first gear wheel 24 is in a freewheeling mode. In this switching position, the grinding wheel 28 is subjected during operation of the power grinder 10 to an eccentric motion, where the grinding wheel 28 can rotate freely about its axis of rotation.

In the switching position shown in FIG. 3, the head 76 of the locking bolt 64 rests on the upper switching plane 60, and the head 78 of the locking bolt 66 rests on the lower switching plane 62 of the switching ring 46. Thus the locking bolt 66 engages a bore 44 of the first gear wheel 24, thereby securing the latter against relative rotation. The diameter of the locking bolt 66 is less than that of the bores 44, so that in operation of the power grinder, the eccentric motions of the first gear wheel 24 about the armature shaft 14 can be compensated for. In this switching position, in operation of the power grinder 10, the grinding wheel 28 is subjected to an oscillating grinding motion, or in other words a purely eccentric motion.

List of Reference Numerals

10 Power grinder
12 Tool housing
14 Armature shaft
16 Recess
18 Eccentric sleeve
20 Bore
22 Screw
24 Gear wheel
26 Ball bearing
28 Grinding wheel
30 Switch device
32 Housing
34 Annular groove
36 Slide bearing ring
38 Gear wheel
40 Meshing region
42 Bores
44 Bores
46 switching ring
48 Grip
50 Slot
52 Recess
54 Recess
56 Chamfer
58 Chamfer
60 Upper switching plane
62 Lower switching plane
64 Locking bolt
66 Locking bolt
68 Spring
70 Spring
72 Slot
74 Slot
76 Head
78 Head

What is claimed is:

1. A hand power tool for grinding or polishing, comprising a drive motor, a gear coupled with the drive motor, and a grinding wheel (28) operatively connected to the gear, wherein the gear has a switch device (30), wherein at least two types of grinding wheel motion can be preselectable by means of the switch device, wherein the switch device cooperates with two pear wheels that mesh with one another, wherein one of said pear wheels is connected to the grinding wheel, wherein the switch device includes at least one locking bolt, wherein said locking bolt cooperates with at least one recess in a first one of the two pear wheels or a second one of the two gear wheels, wherein the switch device has a switching ring, wherein the at least one locking bolt is switchable by means of said switching ring.

2. The hand power tool of claim 1, wherein in at least one preselectable type of motion, an orbital motion of the grinding wheel (28) is effected.

3. The hand power tool of claim 1, wherein In at least one preselectable type of motion, a self-rotation of the grinding wheel (28) is effected.

4. The hand power tool of claim 1, wherein in at least one preselectable type of motion, an orbital motion of the grinding wheel (28) trips a self-rotation of the grinding wheel (28).

5. The hand power tool of claim 1, wherein in at least one preselectable type of motion, an orbital motion of the grinding wheel (28) is effected, and the grinding wheel (28) is in a freewheeling mode with respect to a self-rotation.

6. The hand power tool of claim 1, wherein a rotation of at least one of the gear wheels (24, 38) can be prevented by means of the switch device (30).

7. The hand power tool of claim 1, wherein the gear wheel (24) connected to the grinding wheel (28) has a set of external teeth, wherein the set of external teeth meshes with a set of internal teeth of the other gear wheel (38).

8. The hand power tool of claim 7, wherein the gear wheel (38) having the internal teeth is disposed in a slide bearing ring (36).

9. The hand power tool of claim 1, wherein the at least one locking bolt (64, 66) is guided in an axial, recess (52, 54) in the switching ring (46), wherein the recess if formed as an arc of a circle.

10. The hand power tool of claim 9, wherein the switching ring (46), in the region of the axial recess (52, 54), has a chamfer (56, 58) formed as a ramp, wherein the at least one locking bolt (64, 66) is axially shiftable by rotation of the switching ring (46) by means of the chamfer.

11. The hand power tool of claim 1, wherein the grinding wheel (28) has an outline with at least one straight boundary edge and at least one curved boundary edge.

12. A hand power tool for grinding or polishing, comprising a drive motor, a gear wheel coupled with drive motor, and a grinding wheel (28) operatively connected to the gear wheel, wherein the gear wheel has a switch device (30), wherein at least two types of grinding wheel motion can be preselectable by means of the switch device, wherein the switch device includes a first locking bolt for engaging a recess of the first gear wheel to provide a first grinding wheel motion and a second locking bolt for engaging a recess of a second gear wheel to provide a second grinding wheel motion.

* * * * *